United States Patent [19]

Schmid

[11] 4,106,229

[45] Aug. 15, 1978

[54] VEHICLE SIGN HOLDER

[75] Inventor: Hans F. Schmid, Verona, N.J.

[73] Assignee: Mar-Kal Products Corporation, Montclair, N.J.

[21] Appl. No.: 771,263

[22] Filed: Feb. 23, 1977

[51] Int. Cl.[2] ..... G09F 7/00

[52] U.S. Cl. ..... 40/611; 40/10 R; 40/588; 40/591

[58] Field of Search ..... 40/17, 16 R, 129 C, 40/10 R

[56] References Cited

U.S. PATENT DOCUMENTS

| | | | |
|---|---|---|---|
| 2,951,301 | 9/1960 | Slavsky | 40/17 |
| 3,029,537 | 4/1962 | Hopp et al. | 40/17 |
| 3,510,975 | 5/1970 | Lowmaster | 40/129 C |

*Primary Examiner*—Louis G. Mancene
*Assistant Examiner*—Wenceslao J. Contreras
*Attorney, Agent, or Firm*—B. P. Fishburne, Jr.

[57] ABSTRACT

To comply with certain Federal Government regulations pertaining to the mounting and displaying of hazardous materials placards on trucks, a placard holder has been provided which includes marginal flanges which lie in registration with the border area of the placard, the flanges having the same color as the placard border and thereby appearing to one viewing the placard as a part of the border which must be visible to a viewer under the terms of said regulations. The flanges serve the dual purpose of positioning the placard in the holder.

1 Claim, 5 Drawing Figures

VEHICLE SIGN HOLDER

BACKGROUND OF THE INVENTION

A Government regulation relating to the mounting of hazardous materials placards on trucks gives rise to a need for a placard holder which will make possible compliance with the regulation. Specifically, a regulation requires that so-called diamond-shaped placards contain borders of a specified dimension and that such borders be visible when the placard is mounted. This presents an immediate problem in terms of devising a placard holder which will securely retain the placard on a truck without covering the mandatory border area and blocking it from view.

Accordingly, this invention has for one of its principal objectives the provision of a placard holder for trucks which has marginal flanges in registration with the border area of the placard around three sides of the same, said flanges being of the same width as the border and closely matching the color of the border to thereby provide the illusion from a distance that the placard border is uncovered or clearly exposed to view. Additionally, the holder flanges serve to securely position the placard during use in conjunction with a cooperating clip device which is carried by the holder adjacent to the unflanged edge thereof.

Other features and advantages of the invention will become apparent during the course of the following description.

DETAILED DESCRIPTION

Figure 1:
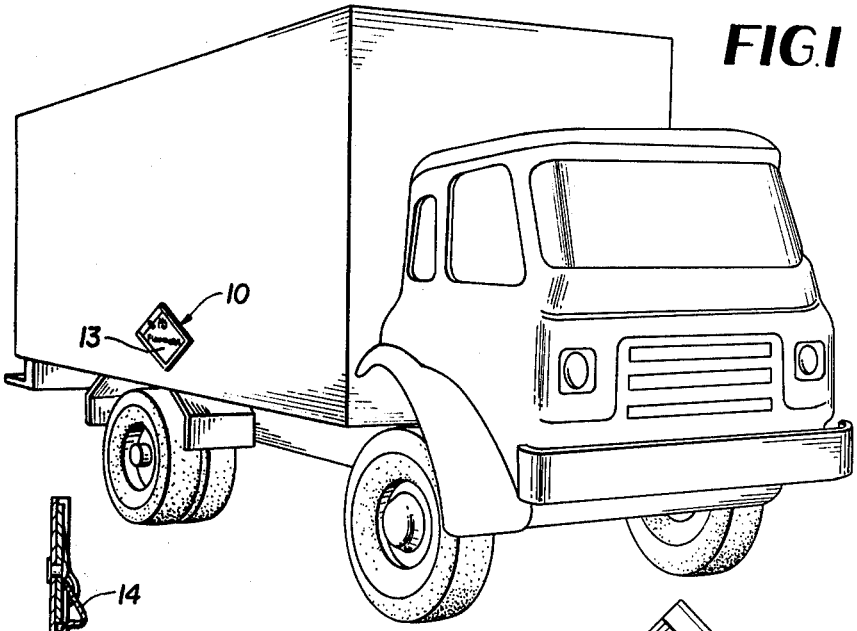
FIG. 1 is a perspective view showing a placard holder according to the invention on one side of a truck body.

Referring to the drawings in detail, wherein like numerals designate like parts, a placard holder 10 formed of sheet metal is rectangular and includes a flat rear plate body 11 and integral marginal flanges 12 extending around three sides of the holder 10. The fourth or remaining side of the holder is unflanged and open for the reception of a rectangular placard 13 formed of stiff paper or the like.

Figure 3:
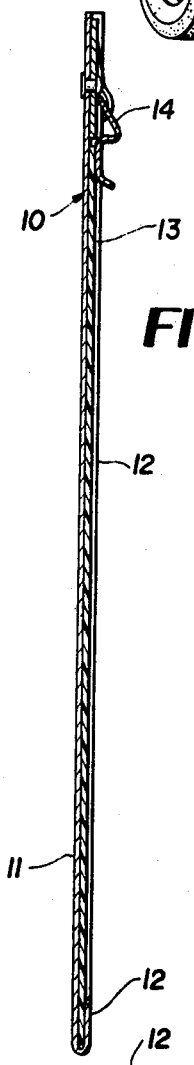
FIG. 3 is a vertical section taken on line 3—3 of FIG. 2.
Figure 2:
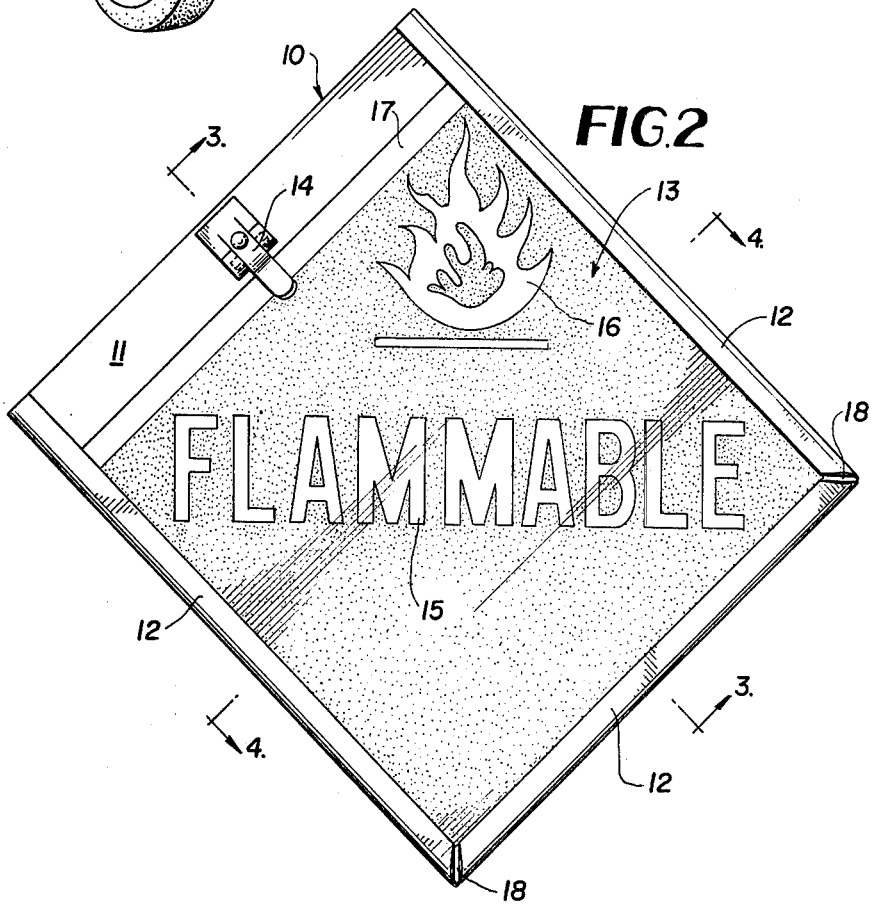
FIG. 2 is an elevational view of the placard and holder on an enlarged scale.
Figure 4:
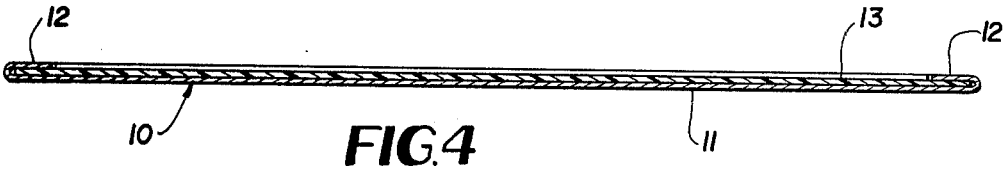
FIG. 4 is a similar section taken on line 4—4 of FIG. 2.

The flanges 12 are of uniform width around the three sides of the placard holder, such as one-half inch. They lie parallel to the plane of the plate body 11 and spaced sufficiently therefrom, FIGS. 3 and 4, to allow the placard 13 to be slid under the three flanges when placed in the holder, the two parallel flanges 12 providing channels with the plate body 11 to guide the placard into place. When in place, FIG. 2, the three flanges stabilize and position the placard properly in the holder. A clip device 14 of any conventional type is provided on the holder adjacent to its open side, and includes a spring clip leg which overlies the adjacent edge of the placard to secure it in fixed relation to the holder 10. As shown in the drawings, the rectangular holder is somewhat longer than the placard to make space for the mounting of the clip device, the placard 13 being substantially square.

The placard is employed under mandatory regulations to indicate hazardous materials of various sorts in trucks. Such materials include flammables, explosives, corrosives and the like. In the drawing illustration, the placard 13 carries the word "flammable" at 15 above which a flame symbol 16 is imprinted on the placard at one corner thereof. The word "flammable" extends diagonally or across corners on the square placard to render the same "diamond-shaped" in terms of the regulation. As shown in FIG. 1, the holder 10 is mounted on the side of the truck at an angle to properly display the placard 13 with the word 15 arranged horizontally under the regulation.

Figure 5:
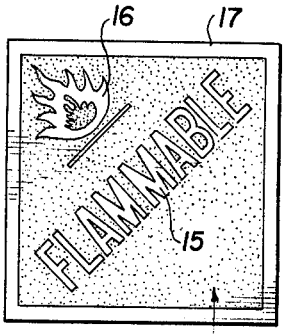
FIG. 5 is an elevational view of a placard on a reduced scale.

Referring to FIG. 5, the square placard 13 has a border 17 of uniform width extending continuously around its margin. This border is of contrasting color to the central area of the placard and is usually of the same color as the indicia 15 and 16. For example, the border 17 and indicia 15 and 16 may be snow white with the remainder of the placard bright red to indicate hazard or danger. One aspect of the Government regulation is that the entire border 17 be visible when the placard 13 is placed in the holder 10. Since the holder flanges 12 overlie the border 17 and are of the same width as the border and coincide therewith, they naturally hide three sides or sections of the border 17. However, by making the flanges 12 exactly the same color as the placard border 17, an illusion is created and a viewer of the placard and holder a short distance from it will have the impression that the border is uncovered and visible entirely around the placard 13.

A further feature of the invention is the provision at two corners of the holder 10 of spaces 18 or gaps between adjacent flange sections 12. These gaps allow rainwater to drain freely from the lowermost corner of the holder when it is mounted as shown in the drawings.

It can now be understood that the holder flanges 12 serve several important functions, namely, to secure and position the placard 13, to create the optical illusion of a continuous uninterrupted placard border and to form drainage means. The construction of the holder is simple, economical and neat in appearance.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A holder for rectangular placards of the type having a central indicia bearing area and a continuous marginal border surrounding said area and being of a uniform width, said marginal border being of a single color which contrasts with the background color of the central indicia bearing area of the placard, said holder comprising a substantially flat plate body of a size and shape to substantially register with a placard placed thereon, and integral marginal flanges on the plate body extending substantially around three sides thereof, the placard and plate body being rectangular, the flanges being of equal width with the placard marginal border and overlapping one face of the plate body and registering with said marginal border on three sides of the placard with the fourth side of the marginal border of the placard uncovered and exposed to view, and said flanges of the plate body having the color of the marginal border to create the optical illusion to a distant viewer that the complete marginal border of the placard is exposed and uncovered, and a clip means on the plate body engaging the placard to secure the same releasably in the holder.

* * * * *